US006224695B1

(12) United States Patent
Kobayashi et al.

(10) Patent No.: US 6,224,695 B1
(45) Date of Patent: May 1, 2001

(54) NI-BASE DIRECTIONALLY SOLIDIFIED ALLOY CASTING MANUFACTURING METHOD

(75) Inventors: Toshiharu Kobayashi; Yutaka Koizumi, both of Ryugasaki; Hiroshi Harada, Tsukuba; Toshihiro T. Y. Yamagata, Yokohama; Akira Tamura, Chiba-ken; Seiya Nitta, Funabashi, all of (JP)

(73) Assignees: National Research Institute for Metals, Science and Technology Agency, Tsukuba; Kawasaki Jukogyo Kabushiki Kaisha, Kobe, both of (JP)

( * ) Notice: Subject to any disclaimer, the term of this patent is extended or adjusted under 35 U.S.C. 154(b) by 0 days.

(21) Appl. No.: 09/257,910

(22) Filed: Feb. 26, 1999

(30) Foreign Application Priority Data

Mar. 2, 1998 (JP) ..... 10-066204

(51) Int. Cl.[7] ..... C22F 1/10
(52) U.S. Cl. ..... 148/675; 148/555
(58) Field of Search ..... 148/555, 675, 148/410, 404

(56) References Cited

U.S. PATENT DOCUMENTS 4,169,742 * 10/1979 Wukusick et al. ..... 148/32.5
4,859,416 * 8/1989 Adelman ..... 420/443
5,069,873 * 12/1991 Harris et al. ..... 420/448
5,173,255 12/1992 Ross et al. .
5,403,546 * 4/1995 Khan et al. ..... 420/448
5,417,782 * 5/1995 Rongvaux ..... 148/675
5,916,382 * 6/1999 Sato et al. ..... 148/404

FOREIGN PATENT DOCUMENTS

675256 A5 9/1990 (CH) .
0 194 925 A1 9/1986 (EP) .
0 246 082 A1 11/1987 (EP) .
0 362 661 A1 4/1990 (EP) .
54-58621 5/1979 (JP) .
2-149627 6/1990 (JP) .
2-153037 6/1990 (JP) .

* cited by examiner

*Primary Examiner*—Deborah Yee
(74) *Attorney, Agent, or Firm*—Oliff & Berridge, PLC

(57) ABSTRACT

A Ni-base directionally solidified alloy casting is produced by casting a Ni-base directionally solidified alloy having a composition of 10 to 14 wt. % Co, 2 to 3 wt. % Cr, 1.5 to 2.5 wt. % Mo, 5 to 6.5 wt. % W, 5.7 to 6.5 wt. % Al, 5.5 to 6.5 wt. % Ta, 4.5 to 5.0 wt. % Rd, 0.01 to 1.5 wt. % Hf, 0.01 to 0.30 wt. % C, 0.01 to 0.03 wt. % B, and the balance of Ni and inevitable impurities. The Ni-base directionally solidified alloy casting is subjected to a solid solution treatment process at a temperature in the range of 1250 to 1300° C. Then the Ni-base directionally solidified alloy casting is subjected to a two-stage aging process for aging the Ni-base directionally solidified alloy casting at a temperature in the range of 750 to 1200° C.

12 Claims, 2 Drawing Sheets

NI-BASE DIRECTIONALLY SOLIDIFIED ALLOY CASTING MANUFACTURING METHOD

BACKGROUND OF THE INVENTION

1. Field of the Invention

The present invention relates to a method of manufacturing a casting of a Ni-base directionally solidified alloy (hereinafter referred to as "Ni-base DS alloy"), which is used for forming turbine blades and turbine vanes for jet engines and industrial gas turbines.

2. Description of the Related Art

Generally known commercial Ni-base DS alloys include IN792 (9.0 wt. % Co, 12.7 wt. % Cr, 2.0 wt. % Mo, 3.9 wt. % W, 3.2 wt. % Al, 3.9 wt. % Ta, 0.21 wt. % C, 0.02 wt. % B, 4.2 wt. % Ti, 0.10 wt. % Zr, and the balance of Ni), Rene 80 (9.5 wt. % Co, 14.0 wt. % Cr, 4.0 wt. % Mo, 4.0 wt. % W, 3.0 wt. % Al, 0.17 wt. % C, 0.015 wt. % B, 5.0 wt. % Ti, 0.03 wt. % Zr, and the balance of Ni) and Mar-M247 (10.0 wt. % Co, 8.5 wt. % Cr, 0.65 wt. % Mo, 10.0 wt. % W, 5.6 wt. % Al, 3.0 wt. % Ta, 1.4 wt. % Hf, 0.16 wt. % C, 0.015 wt. % B, 1.0 wt. % Ti, 0.04 wt. % Zr, and the balance of Ni). Although inferior in strength at elevated temperature to Ni-base single crystal alloys (Ni-base SC alloys), these Ni-base DS alloys have no directional property when cast and are less subject to cracking. Therefore products of these Ni-base DS alloys are manufactured at a high yield and do not require complicated heat-treatment processes.

Raising the temperature of a combustion gas for driving turbines is the most effective method of improving the efficiency of jet engines and industrial turbines. Therefore it is desired that Ni-base DS alloys having further enhanced strength at elevated temperature, ductility and high-temperature corrosion resistance are developed.

SUMMARY OF THE INVENTION

Accordingly, it is an object of the present invention to provide a Ni-base DS alloy casting manufacturing method capable of manufacturing a Ni-base DS alloy casting exceptionally excellent in strength at elevated temperature, ductility and high-temperature corrosion resistance.

According to a first aspect of the present invention, a Ni-base DS alloy casting manufacturing method processes a Ni-base DS alloy casting of a Ni-base DS alloy having a composition of 10 to 14 wt. % Co, 2 to 3 wt. % Cr, 1.5 to 2.5 wt. % Mo, 5 to 6.5 wt. % W, 5.7 to 6.5 wt. % Al, 5.5 to 6.5 wt. % Ta, 4.5 to 5.0 wt. % Re, 0.01 to 1.5 wt. % Hf, 0.01 to 0.30 wt. % C, 0.01 to 0.03 wt. % B, and the balance of Ni and inevitable impurities by a two-stage aging process for aging the Ni-base DS alloy casting at a temperature in the range of 750 to 1200° C.

According to a second aspect of the present invention, a Ni-base DS alloy casting manufacturing method processes a Ni-base DS alloy casting of a Ni-base DS alloy having a composition of 10 to 14 wt. % Co, 2 to 3 wt. % Cr, 1.5 to 2.5 wt. % Mo, 5 to 6.5 wt. % W, 5.7 to 6.5 wt. % Al, 5.5 to 6.5 wt. % Ta, 4.5 to 5.0 wt. % Re, 0.01 to 1.5 wt. % Hf, 0.01 to 0.30 wt. % C, 0.01 to 0.03 wt. % B, and the balance of Ni and inevitable impurities by a solid solution treatment at a temperature in the range of 1250 to 1300° C., and then processes the Ni-base DS alloy casting by a two-stage aging process at a temperature in the range of 750 to 1200° C.

In a Ni-base DS alloy subject to γ'-phase precipitation hardening by aluminum (Al), cobalt (Co) makes the component elements dissolve satisfactorily in the matrix in a solid solution treatment, and precipitate homogeneously in a fine γ'-phase by the subsequent aging process, so that the Ni-base DS alloy has a high strength at elevated temperature.

When the Co content is less than 10% by weight, only a narrower temperature range is available for solid solution treatment. If the Co content is more than 14% by weight, the precipitated γ'-phase decreases and the strength at an elevated temperature is lowered. The Co content is preferably in the range of 11 to 13% by weight.

Chromium (Cr) is added to the Ni-base DS alloy to give Ni-base DS alloy oxidation resistance and corrosion resistance. The alloy has a low high-temperature corrosion resistance if the Cr content is less than 2% by weight, and a detrimental TCP structure (topologically closed packed structure) is formed if the Cr content is more than 3% by weight. A preferably Cr content is in the range of 2.5 to 3% by weight.

Molybdenum (Mo) dissolves in the matrix and increases strength at an elevated temperature and provides strength at an elevated temperature by precipitation hardening. Raft effect produced by making misfit between the γ-phase and the γ'-phase negative, is insufficient if the Mo content is less than 1.5% by weight and the TCP structure is produced if the Mo content is more than 2.5% by weight. A preferable Mo content is in the range of 1.8 to 2.2% by weight.

Tungsten (W) promotes solid solution hardening and precipitation hardening. Incomplete solid solution hardening occurs and the creep strength decreases if the W content is less than 5% by weight, and a TCP structure is formed if the W content is more than 6.5% by weight. A preferable W content is in the range of 5.5 to 6.2% by weight.

Aluminum (Al) is necessary for the precipitation of the γ'-phase. The amount of the precipitated γ'-phase is excessively smaller and the strength at an elevated temperature decreases if the Al content is less than 5.7% by weight, and the amount of the precipitated eutectic γ'-phase is excessively larger and the solid solution treatment becomes difficult if the Al content is more than 6.5% by weight. A preferable Al content is in the range of 5.9 to 6.1% by weight.

Tantalum (Ta), similarly to Mo, contributes to the enhancement of the strength at an elevated temperature by the solid solution hardening and the γ'-phase precipitation hardening. The solid solution hardening effect of the γ'-phase is insufficient and the strength at an elevated temperature decreases if the Ta content is less than 5.5% by weight, and the amount of the eutectic γ'-phase increases excessively and the solid solution hardening treatment becomes difficult if the Ta content is more than 6.5% by weight. The Ta content is preferably in the range of 5.7 to 6.2% by weight.

Hafnium (Hf) contributes to crystal stressing during columnar crystallization by directional solidification. The crystal stressing effect of Hf is unavailable and longitudinal cracks develop along grain boundaries during solidification if the Hf content is less than 0.01% by weight, and Hf combines with oxygen to form an oxide in the alloy and cracks develop if the Hf content is more than 1.5% by weight. The Hf content is preferably in the range of 0.01 to 0.3% by weight and more preferably in the range of 0.05 to 0.2% by weight.

Rhenium (Re) contributes to phase stabilization. The solid solution hardening of the γ'-phase is insufficient and the strength at an elevated temperature decreases if the Re content is less than 4.5% by weight, and a TCP structure is formed and the range of temperature suitable for the solid solution hardening treatment is narrowed if the Re content is more than 5% by weight. The Re content is preferably in the range of 4.7 to 5% by weight.

Carbon (C) contributes to crystal stressing. The effect of C on crystal stressing is insignificant if the C content is less than 0.01% by weight, and the ductility is reduced if the C content is more than 0.3% by weight. The C content is preferably in the range of 0.05 to 0.1% by weight.

Boron (B), similarly to C, contributes to crystal stressing. The effect of B on crystal stressing is insignificant if the B content is less than 0.01% by weight, and the ductility is reduced if the B content is more than 0.03% by weight. The B content is preferably in the range of 0.01 to 0.02% by weight.

Zirconium (Zr) may be added to the Ni-base DS alloy in a Zr content of 0.3% or less by weight for crystal stressing.

One or some of titanium (Ti), niobium (Nb) and vanadium (V), which are added generally to Ni-base superalloys, may be added to the Ni-base DS alloy. It is desirable that the Ti content is 2% or less by weight, the Nb content is 2% or less by weight and the V content is 0.5% or less by weight.

The solid solution treatment of the γ'-phase is insufficient and the subsequent precipitation by aging is insufficient if a temperature for solid solution treatment is less than 1250° C., and partial melting occurs and the strength is liable to decrease if the temperature for solid solution treatment exceeds 1300° C. The temperature for solid solution treatment is preferably in the range of 1260 to 1290° C.

The diffusion coefficients of the elements in the alloy becomes smaller if a temperature for aging is below 750° C., and crystal grains of the γ'-phase grow excessively during aging and the strength is reduced if temperature for aging exceeds 1200° C. The temperature for aging is preferably in the range of 850 to 1160° C.

A preferably temperature for fist stage aging is in the range of 1080 to 1160° C. The precipitated γ'-phase is disarranged and the strength decreases if the temperature for first stage aging is less than 1080° C., and grains of the precipitated γ'-phase grow excessively if the temperature for first stage aging is above 1160° C.

A preferable temperature for second stage aging is in the range of 850 to 900° C. The amount of the precipitated γ'-phase decreases and the strength decreases if the temperature for second stage aging is outside the foregoing temperature range.

A preferable time for solid solution treatment is in the range of 1 to 6 hr. The solution treatment of the γ'-phase is insufficient if the time for solid solution treatment is less than 1 hr, and the surface layer is deteriorated and the cost increases if the time for solid solution treatment exceeds 6 hr.

Preferably, a time for first stage aging is in the range of 1 to 8 hr, a time for second stage aging is in the range of 8 to 32 hr and a total time for aging is in the range of 9 to 40 hr. The precipitated γ'-phase is disordered if the time for first stage aging is less than 1 hr, grains of the precipitated γ'-phase grow excessively if the time for first stage aging exceeds 8 hr. Those cases entail reduction of the strength. The amount of the precipitated γ'-phase is insufficient if the time for second stage aging is less than 8 hr, and if the time for second stage aging exceeds 32hr, the cost becomes increased.

DESCRIPTION OF THE PREFERRED EMBODIMENTS

EXAMPLE 1

Four Ni-base DS alloy castings (hereinafter referred to simply as "alloy castings") of a Ni-base DS alloy having a composition of 12 wt. % Co, 3 wt. % Cr, 2 wt. % Mo, 6 wt. % W, 6 wt. % Al, 6 wt. % Ta, 5.0 wt. % Re, 0.1 wt. % Hf, 0.07 wt. % C, 0.015 wt. % B, and the balance of Ni and inevitable impurities were produced by melting the Ni-base DS alloy, casting the molten Ni-base DS alloy and solidifying the castings in a vacuum at a solidification rate of 200 mm/hr.

The alloy castings were subjected to a solid solution treatment comprising sequential steps of preheating the alloy castings in a vacuum at 1225° C. for 1 hr, heating the alloy castings to 1275° C., keeping the alloy castings at 1275° C. for 5 hr, and air-cooling the alloy castings. Then, the alloy castings were subjected to a two-stage aging process including a first stage aging which kept the alloy castings in a vacuum at 1150° C. for 5 hr and then air-cooled the alloy castings, and a second stage aging which kept the alloy castings in a vacuum at 870° C. for 20 hr and then air-cooled the alloy castings.

The alloy castings thus processed were machined to obtain four test specimens Nos. 1 to 4, each having a parallel section of 4 mm in diameter and 20 mm in length. The test specimens were subjected to creep tests under test conditions tabulated in Table 1 to measure life, elongation and reduction of area. Test results are tabulated in Table 1.

TABLE 1

| Test specimens | Temperature (° C.) | Stress (kfg/mm$^2$) | Life (hr) | Elongation (%) | Reduction of Area (%) | LMP P = 20 (×1000) |
|---|---|---|---|---|---|---|
| 1 | 1100 | 14 | 93.43 | 11.4 | 18.4 | 30.17 |
| 2 | 900 | 40 | 518.9 | 10.8 | 17.9 | 26.65 |
| 3 | 1040 | 14 | 884.07 | 18.6 | 32.3 | 30.13 |
| 4 | 1000 | 20 | 444.33 | 18.8 | 18.7 | 28.83 |
| 5 | 900 | 40 | 300.75 | 13.3 | 13.7 | 26.37 |
| 6 | 1100 | 14 | 50.7 | 15.3 | 40.8 | 29.80 |

Figure 1:
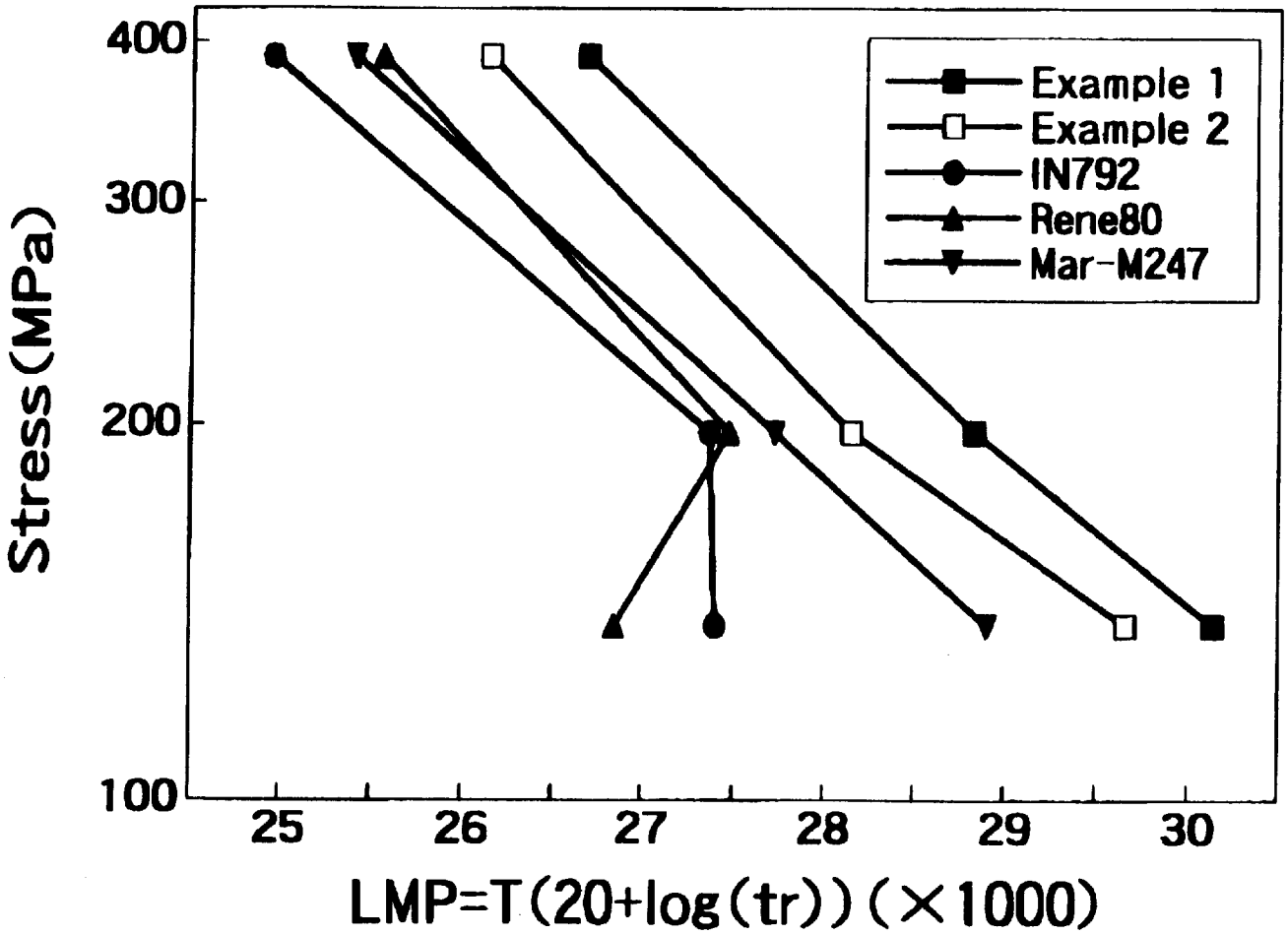
FIG. 1 is a graph showing the results of creep tests of Ni-base DS alloys of the present invention and conventional Ni-base DS alloys by Larson-Miller parameters (LMPs)

LMPs were calculated by using:

$LMP=T(20+\log t_r)\times 1000$, where T is test temperature (K), and $t_r$ is rupture life (hr). LMPs are shown in FIG. 1. LMPs of comparative test specimens of commercial Ni-base DS alloys, i.e., IN792, Rene 80 and Mar-M247, are shown also in FIG. 1 for comparison.

In FIG. 1, data in an upper left part are those obtained when temperature was low and stress was high, and data in a lower right part are those obtained when temperature was high and stress was low. In FIG. 1, curves representing greater LMPs for the same stress are those for test specimens having higher creep strengths.

As is obvious from FIG. 1, the creep strength of the Ni-base DS alloy in Example 1 is far higher than those of the commercial Ni-base DS alloys IN792, Rene 80 and Mar-M247 over the entire range of a low-temperature high-stress state to a high-temperature low-stress state. A temperature at which the Ni-base DS alloy in Example 1 withstood a creep test exerting a stress of 196 MPa for 1000 hr was about 50° C. higher than that at which Mar-M247 could withstand the same creep test.

Figure 2:
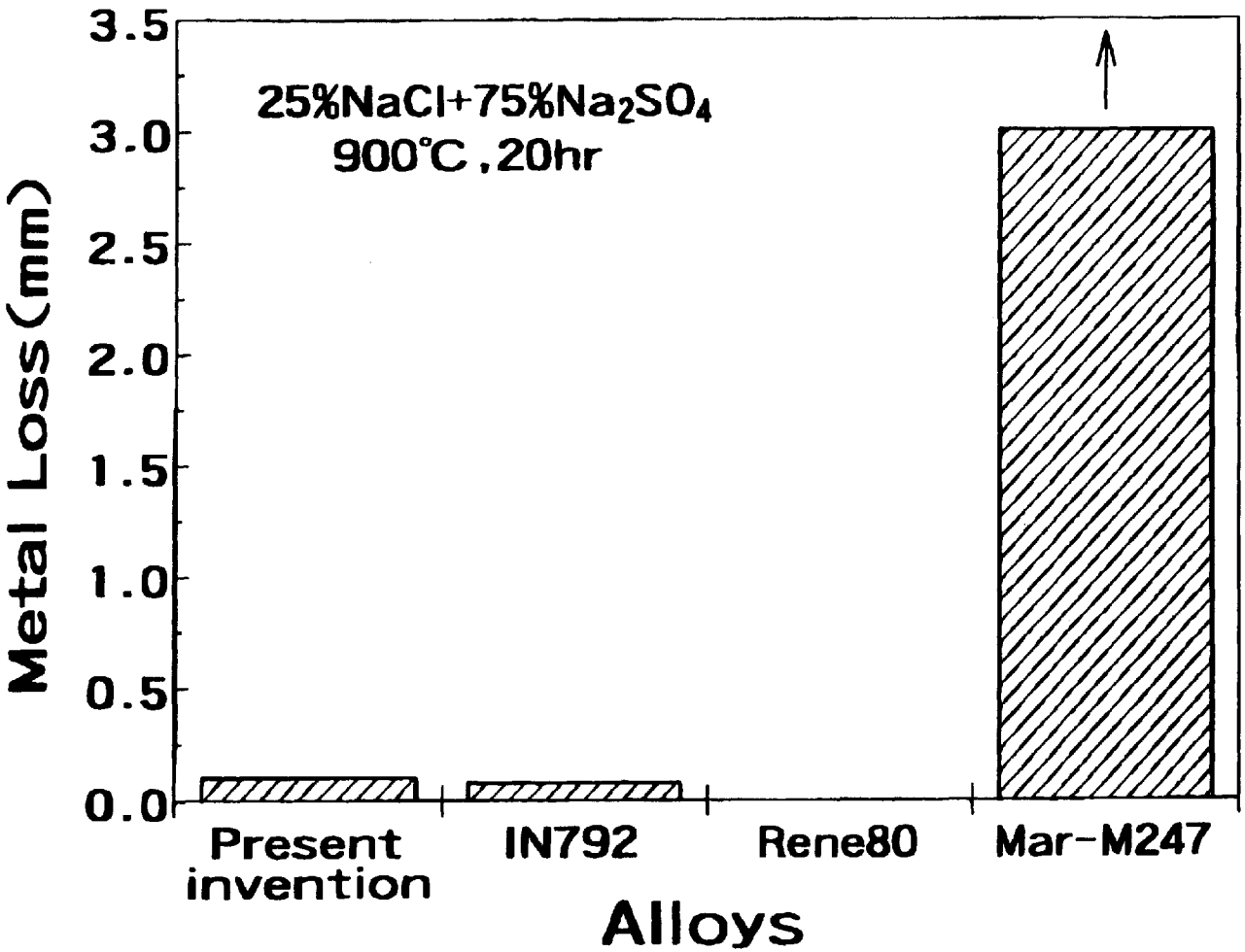
FIG. 2 is a graph showing the results of corrosion tests of Ni-base DS alloys of the present invention and conventional Ni-base DS alloys.

Test specimens of 6 mm in diameter and 4.5 mm in length of the Ni-base DS alloy in Example 1, and the commercial Ni-base DS alloys IN792, Rene 80 and Mar-M247 were subjected to corrosion tests. Results of corrosion tests are shown in FIG. 2. In the corrosion tests, the test specimens were immersed in a molten salt of 25% NaCl and 75% $Na_2SO_4$ heated at 900° C. for 20 hr. The corrosion resistance of the specimens was evaluated by the depth of corrosion from the surface. As is obvious from FIG. 2, the Ni-base DS alloy Example 1 bears comparison with the commercial Ni-base DS alloys IN792 and Rene 80 in corrosion resistance. The test specimens of the commercial Ni-base DS alloy Mar-M247 were totally corroded and melted away.

EXAMPLE 2

Two Ni-base DS alloy castings (alloy castings) in Example 2having the same composition as that of Example 1 were produced by the same procedure. Then, the alloy castings were subjected to a two-stage aging process including a first stage aging which kept the alloy castings in a vacuum at 1150° C. for 5 hr and then air-cooled the alloy castings, and a second stage aging which kept the alloy castings in a vacuum at 870° C. for 20 hr and then air-cooled the alloy castings.

The alloy castings thus processed were machined to obtain two test specimens Nos. 5 and 6 of the same dimensions as those of the specimens Nos. 1 to 4. The test specimens were subjected to creep tests under test conditions tabulated in Table 1 to measure life, elongation and reduction of area. Test results are shown in Table 1 and LMPs are shown in FIG. 1.

As is obvious from Table 1 that the Ni-base DS alloy in Example 2 is somewhat inferior in creep strength to the Ni-base DS alloy in Example 1 and is superior in ductility to the Ni-base DS alloy in Example 1.

It is known from FIG. 1, the creep strength of the Ni-base DS alloy in Example 2 is far higher than those of the commercial Ni-base DS alloys IN792, Rene 80 and Mar-M247 over the entire range of a low-temperature high-stress state to a high-temperature low-stress state.

Corrosion tests proved that the corrosion resistance of the Ni-base DS alloy in Example 2 is substantially equal to that of the Ni-base DS alloy in Example 1.

As is apparent from the foregoing description, in the Ni-base DS alloy in Example 1, Hf contributes to the crystal stressing during columnar crystallization, Re contributes to phase stabilization, and C and B contribute to crystal stressing. Therefore, the Ni-base DS alloy in Example 1 is far superior in strength at elevated temperature, ductility and high=temperature corrosion resistance to the conventional Ni-base DS alloys. The Ni-base DS alloy in Example 1 is suitable particularly for forming machine parts in which importance is attached to creep strength.

The Ni-base DS alloy in Example 2 is the same in performance and effects as the Ni-base DS alloy in Example 1. The Ni-base DS alloy in Example 2 is suitable particularly for forming machine parts in which importance is attached to ductility.

What is claimed is:

1. A Ni-base directionally solidified alloy casting manufacturing method comprising:

a process of producing a Ni-base directionally solidified alloy casting by casting a Ni-base directionally solidified alloy having a composition of 10 to 14 wt. % Co, 2 to 3 wt. % Cr, 1.5 to 2.5 wt. % Mo, 5 to 6.5 wt. % W, 5.7 to 6.5 wt. % Al, 5.5 to 6.5 wt. % Ta, 4.5 to 5.0 wt. % Re, 0.01 to 0.30 wt. % Hf, 0.01 to 0.30 wt. % C, 0.01 to 0.03 wt. % B, and the balance of Ni and inevitable impurities; and a process of subjecting the Ni-base directionally solidified alloy casting to a two-stage aging process comprising a first stage aging and a second stage aging, for aging, the Ni-base directionally solidified alloy casting at temperatures in the range of 750 to 1200° C.

2. The Ni-base directionally solidified alloy casting manufacturing method according to claim 1, further comprising a process of heating the Ni-base directionally solidified alloy casting at a temperature in the range of 1250 to 1300° C. for a solid solution treatment before the same is subjected to the two-stage aging process.

3. The Ni-base directionally solidified alloy casting manufacturing method according to claim 1, wherein the process of producing the Ni-base directionally solidified alloy casting comprises a process of adding 0.3 wt. % or less Zr.

4. The Ni-base directionally solidified alloy casting manufacturing method according to claim 1, wherein the process of producing the Ni-base directionally solidified alloy casting comprises a process of adding at least one of 2 wt. % or less Ti, 2 wt. % or less Nb and 0.5 wt. % or less V.

5. The Ni-base directionally solidified alloy casting manufacturing method according to claim 1, wherein the first stage aging of the two-stage aging process is carried out at a temperatures in the range of 1080 to 1160° C.

6. The Ni-base directionally solidified alloy casting manufacturing method according to claim 1, where the second stage aging of the two-stage aging process is carried out at a temperature in the range of 850 to 900° C.

7. The Ni-base directionally solidified alloy casting manufacturing method according to claim 1, wherein the first stage aging of the two-stage aging process is carried out for a time in the range of 1 to 8 hr.

8. The Ni-base directionally solidified alloy casting manufacturing method according to claim 1, wherein the second stage aging of the two-stage aging process is carried out for a time in the range of 8 to 32 hr.

9. The Ni-base directionally solidified alloy casting manufacturing method according to claim 1, wherein the sum of the time for the first stage aging and that for the second stage aging is in the range of 9 to 40 hr.

10. The Ni-base directionally solidified alloy casting manufacturing method according to claim 2, wherein the solid solution treatment is carried out at a temperature in the range of 1260 to 1290° C.

11. The Ni-base directionally solidified alloy casting manufacturing method according to claim 2, wherein the solution treatment is carried out for a time in the range of 1 to 6 hr.

12. The Ni-base directionally solidified alloy casting manufacturing method according to claim 2 further comprising a process for preheating the Ni-base directionally solidified alloy casting at a temperature lower than the temperature for the solid solution treatment before the heating process for heating the Ni-base directionally solidified alloy casting.

* * * * *